US011794965B2

(12) United States Patent
Ferrari et al.

(10) Patent No.: US 11,794,965 B2
(45) Date of Patent: Oct. 24, 2023

(54) FLIP TOP CAP FOR CONTAINERS PROVIDING EVIDENCE OF FIRST OPENING

(71) Applicant: AFFABA & FERRARI S.R.L., Borgo San Giovanni (IT)

(72) Inventors: Silvia Ferrari, Lodi (IT); Guglielmo Ferrari, Lodi (IT)

( * ) Notice: Subject to any disclaimer, the term of this patent is extended or adjusted under 35 U.S.C. 154(b) by 0 days.

(21) Appl. No.: 17/180,820

(22) Filed: Feb. 21, 2021

(65) Prior Publication Data

US 2021/0261308 A1 Aug. 26, 2021

(30) Foreign Application Priority Data

Feb. 24, 2020 (IT) ..... 102020000003724

(51) Int. Cl.
*B65D 55/02* (2006.01)
*B65D 43/02* (2006.01)
*B65D 47/08* (2006.01)

(52) U.S. Cl.
CPC ..... *B65D 55/024* (2013.01); *B65D 43/0235* (2013.01); *B65D 47/0804* (2013.01); *B65D 2401/20* (2020.05); *B65D 2401/25* (2020.05)

(58) Field of Classification Search
CPC ..... B65D 55/024; B65D 43/0235; B65D 47/0804; B65D 2401/20; B65D 2401/25; B65D 2401/30; B65D 2401/45; B65D 47/20; B65D 55/16; B65D 47/0842
USPC ..... 215/250
See application file for complete search history.

(56) References Cited

U.S. PATENT DOCUMENTS 4,838,441 A * 6/1989 Chernack ..... B65D 47/0838 222/153.1
5,358,130 A * 10/1994 Mengeu ..... B65D 47/0838 222/546
7,303,088 B2 * 12/2007 Sawyer ..... B65D 47/0804 222/153.07
2004/0069806 A1 4/2004 Benoit-Gonin
2005/0173368 A1 * 8/2005 Nusbaum ..... B65D 55/024 215/253
2005/0205607 A1 * 9/2005 Hierzer ..... B65D 47/0804 222/546
2006/0011573 A1 1/2006 Herald
(Continued)

FOREIGN PATENT DOCUMENTS

EP 1619135 A1 * 1/2006 ..... B65D 47/0809
EP 1892194 2/2008
(Continued)

*Primary Examiner* — Valentin Neacsu
*Assistant Examiner* — Eric C Baldrighi
(74) *Attorney, Agent, or Firm* — Themis Law

(57) ABSTRACT

A flip top cap for containers providing evidence of first opening includes a cover part and a pourer part coupled by a hinge arrangement and produced as a single piece. The cover part is rotatable around the hinge arrangement to be brought from a closed position engaging the pourer part to an open and separate position with respect to the pourer part, an engagement system engaging the cover part after rotation into a closed position on the pourer part. The engagement system is breakable and is arranged partly on the cover part and partly on the pourer part, and remains integral with at least one of the cover or pourer parts when they are broken at the first opening.

10 Claims, 7 Drawing Sheets

(56) References Cited

U.S. PATENT DOCUMENTS

| | | | | |
|---|---|---|---|---|
| 2007/0138123 | A1* | 6/2007 | Blomdahl | B65D 47/0809 220/254.5 |
| 2007/0138124 | A1* | 6/2007 | Skillin | B65D 47/0828 220/837 |
| 2008/0110933 | A1* | 5/2008 | Goncalves | B65D 47/2031 222/153.05 |
| 2008/0277371 | A1* | 11/2008 | Weist | B65D 47/242 215/277 |
| 2016/0130047 | A1* | 5/2016 | Koenigseder | B65D 47/0804 220/263 |
| 2020/0354118 | A1* | 11/2020 | Ferrari | B65D 41/3428 |
| 2022/0324619 | A1* | 10/2022 | Ferrari | B65D 41/16 |

FOREIGN PATENT DOCUMENTS

| | | | | |
|---|---|---|---|---|
| EP | 2272771 | A1 * | 1/2011 | B65D 47/243 |
| FR | 2927887 | A1 * | 8/2009 | B65D 47/0857 |
| JP | 2004051218 | A * | 2/2004 | |
| KR | 100942642 | | 2/2010 | |
| WO | 2007038991 | | 4/2007 | |
| WO | 20120131097 | | 10/2012 | |

* cited by examiner

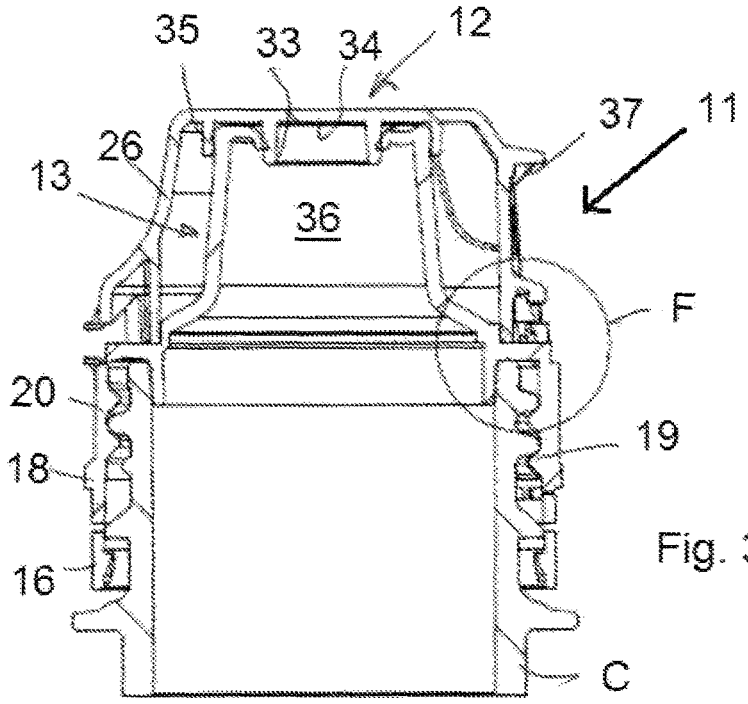
Fig. 3
Fig. 4
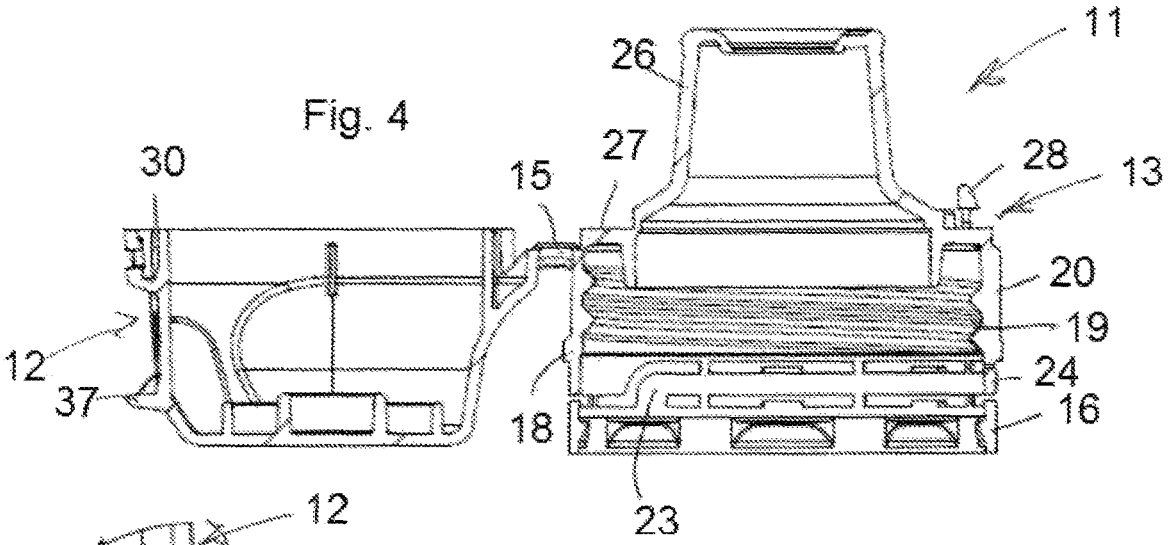
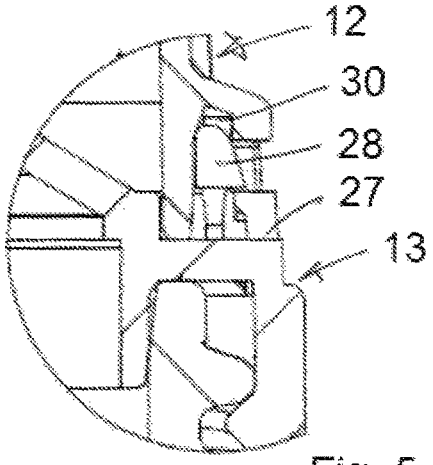
Fig. 5
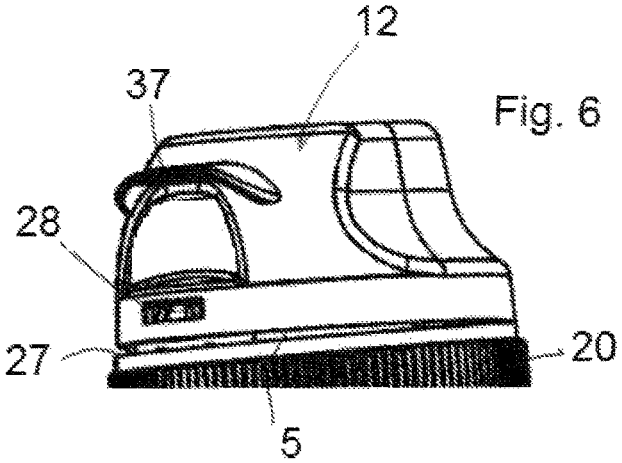
Fig. 6

FLIP TOP CAP FOR CONTAINERS PROVIDING EVIDENCE OF FIRST OPENING

FIELD OF THE INVENTION

The present invention relates to a flip top cap for containers providing evidence of first opening.

BACKGROUND OF THE INVENTION

For the distribution of beverages and other liquid products, such as beverages with vitamin supplements, water containing additives in general, juices, tea, etc., containers or vessels are used on whose mouth the positioning of caps with various types of closure, more or less complex, are provided.

Some of these simplified caps which comprise a protection part with a cover and an internal central pourer part are referred to in the art as "flip top".

The protection part with a cover extends into a base collar which is positioned on the threaded portion of the container mouth. The pourer part is arranged inside the protection part with a cover, connected to the inside of the container.

Liquid product packaging companies require that these closure caps must be produced and constructed in such a way as not to allow any opening or tampering with the contents of the container or vessel on which they are positioned.

For this purpose, their conformation and combination of characteristic parts must be such that, once opened for the first time, they must no longer be able to be closed again, revealing the first opening.

This is to ensure that the internal product is exactly that inserted by the filling company, absolutely original and of good quality in order to avoid the distribution of poor-quality and non-original products.

In view of these particular characteristics, the cap must still have a certain ease of opening, favoring the use of the beverage by consumers, meeting their needs in general.

Despite this, the cap must be able to reveal its integrity with simplicity and immediacy. That is to say, the user, on observing the container provided with this type of cap, must note that the container on which it is positioned, is intact, i.e., it has not already been opened for the first time, providing the consumer with ample reassurance as to the originality of the product.

Further guarantee requirements for the user are however that the cap with a protective cover:

can be positioned very easily on the mouth of the container, once filled;

guarantees preventing a first fraudulent opening and subsequent reclosing not detectable by the user;

reveals the first opening and in no way, once opened, can be closed in the same way as before packaging;

must have an irreversible first opening.

Further guarantees for the product are that this type of cap must be able to be positioned on the container with an optimal seal in its closed position to be maintained until the first opening after sale.

It is known that these requirements have been met by some caps which, moreover, have a great construction complexity and a certain number of constituent parts that make them complex to both produce and mount on the container. This is known to involve assembly costs and the need for having various molds available, which are also expensive.

A flip top cap is disclosed in publication no. US 2004/069806 A1.

SUMMARY OF THE INVENTION

A general objective of the present invention is therefore to find an adequate solution to the various problems previously indicated and cited.

A further objective of the invention is to provide a flip top cap which can guarantee the evidence of any type of tampering with respect to its positioning in the filling phase with the original contents.

Another objective of the invention is to provide a flip top cap for containers with evidence of opening which is simple and inexpensive as well as being particularly simple to use and operate.

Yet another objective of the invention is to provide a flip top cap for containers with a minimum number of components and assembly activities.

The above-mentioned objectives are achieved by a flip top cap for containers with evidence of first opening, of which the following description provides a few embodiments.

BRIEF DESCRIPTION OF THE DRAWINGS

The structural and functional characteristics of the present invention and its advantages with respect to the known art will become even more evident from the following description, referring to the attached schematic drawings, which show an embodiment example of the invention.

In the drawings:

FIG. 3 is a section along the line III-III of FIG. 1;

FIG. 4 is a raised sectional view of the cap of FIG. 1 in an open position, as formed and intact before its opening;

FIG. 5 shows an enlarged detail as indicated in the circle F indicated in FIG. 3;

FIG. 6 shows an enlarged detail of the cap when the free end of the arrow element has been opened and broken and the cover part can no longer be completely closed on the pourer part;

FIG. 9 shows what is indicated in the circle D indicated in FIG. 1 with the cap intact and FIG. 10 shows these elements once a first opening has been effected and the cap can no longer be closed perfectly as it is no longer possible to bring the cover part in contact with the underlying pourer part;

DETAILED DESCRIPTION OF EMBODIMENTS OF THE INVENTION

Figure 1:
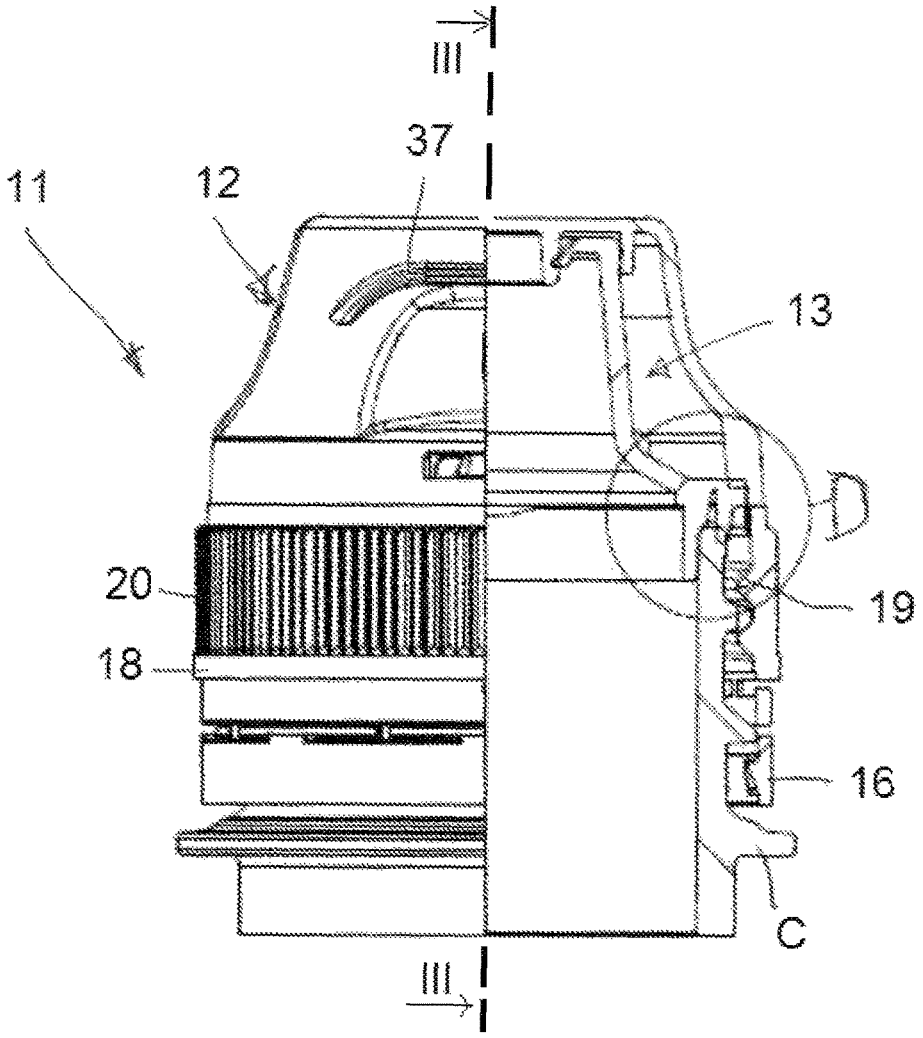
FIG. 1 shows a flip top cap for containers with evidence of first opening according to the present invention, half in a front raised view and half in a sectional view according to the line I-I of FIG. 2, when placed on a mouth of a container, showing a first arrangement of breakable engagement means between the parts of the cap.
Figure 2:
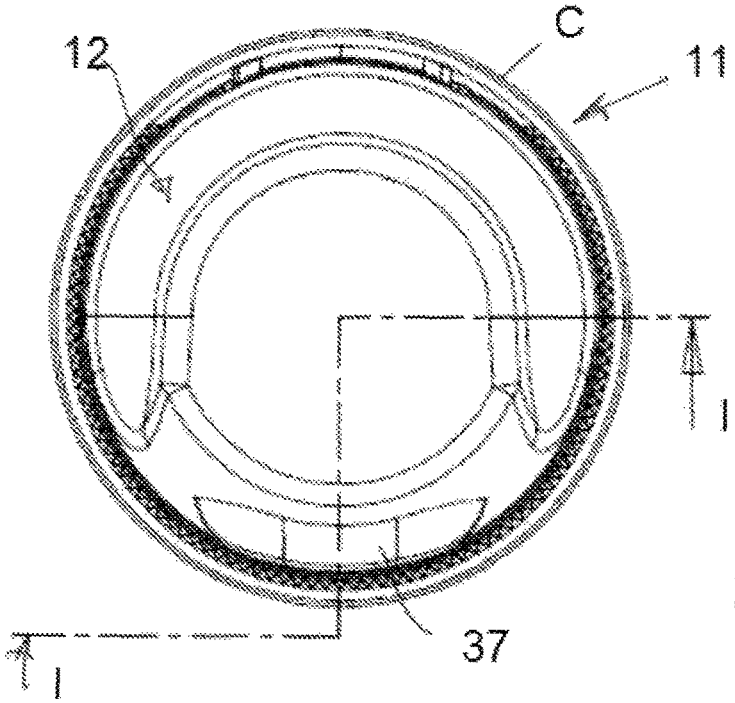
FIG. 2 is a plan view from above of the cap of FIG. 1.

With reference in general to the exemplary and non-limiting figures, an embodiment of a flip top cap for containers with evidence of first opening is shown, indicated as a whole with 11.

In the following description, for illustrating the figures, identical reference numbers are used for indicating construction elements having the same function. Furthermore, for clarity of illustration, some numerical references may not have been repeated in all the figures. Indications such as "vertical" and "horizontal", "upper" and "lower" (in the absence of other indications) should be read with reference to the assembly (or operating) conditions and referring to the normal terminology used in current language, wherein "vertical" indicates a direction substantially parallel to that of the force of gravity vector "g" and a horizontal direction perpendicular to it.

With respect therefore to this first embodiment, the cap 11 is arranged for closing a container, in particular on a screw neck (partially shown in C), and comprises an outer protective cover part 12 and a pourer part 13. The pourer part 13 is suitable for being arranged on an external threaded portion of the screw neck C. As already mentioned, this type of cap is referred to in the field of caps for containers as "flip top".

According to the present invention, the outer protective cover part 12 and the pourer part 13 are produced in a single piece, for example by molding.

More specifically, the cover part 12 is substantially in the form of an inverted cup (see FIG. 4) and is connected via a hinge arrangement 15 to the pourer part 13. The hinge arrangement 15 in the example consists of a bridge (see FIG. 7) of a yielding and elastic type that allow an easy articulation between the parts.

The pourer part 13 provides a cylindrical section which comprises a lower ring or tamper-proof ring 16, two string portions 17 and an upper ring 18. The lower or tamper-proof ring 16 provides a first series of breakable bridges 21 above, which connect it to a lower circumferential facing surface of the two string portions 17. The two string portions 17 in an upper circumferential surface are in turn connected by means of a second series of bridges 22 to the above-mentioned upper ring 18. This upper ring 18 is provided with a portion internally threaded in 19, and extends above in a knurled portion 20.

Figure 7:
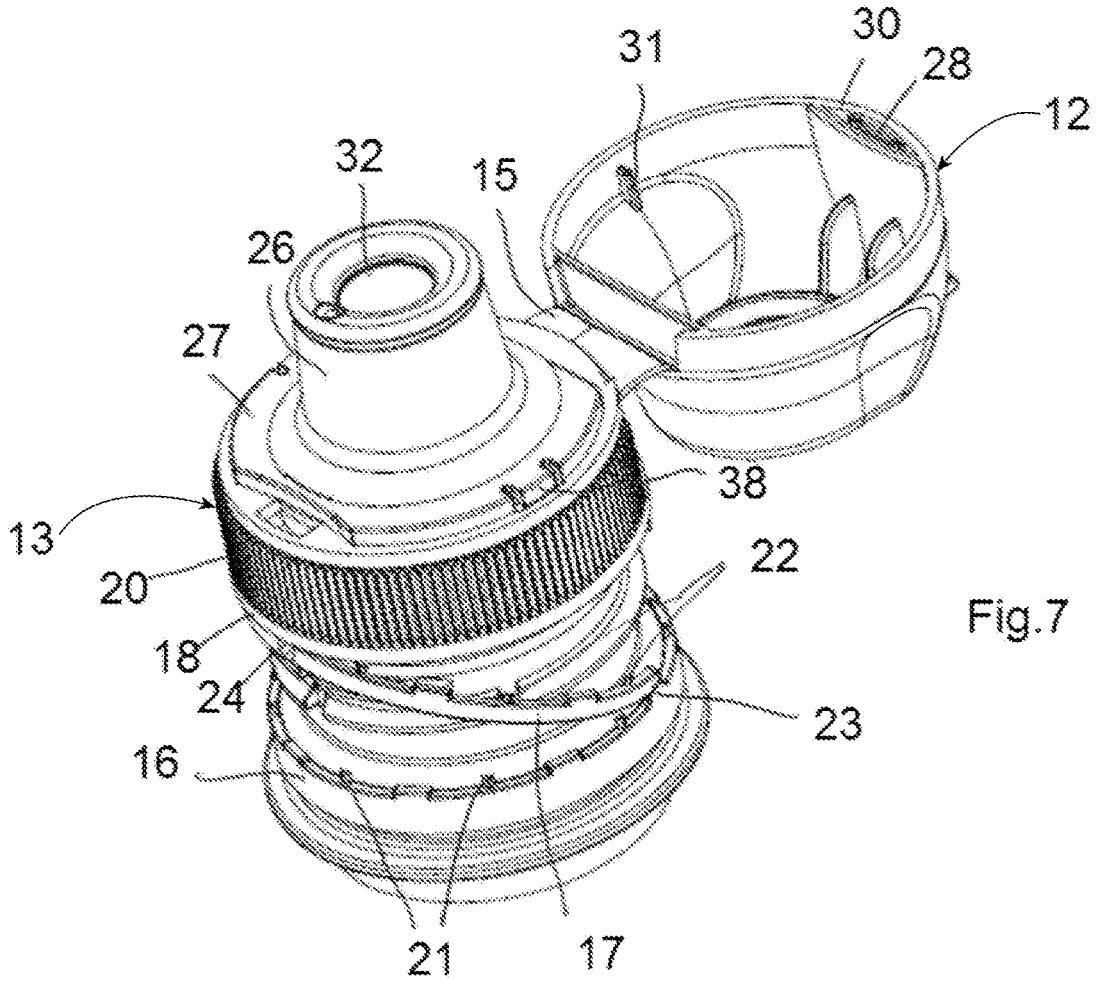
FIG. 7 is a perspective view of the cap of FIG. 1 in an open position when it reveals that it has been opened.

The two string portions 17 are connected at their opposite ends on one side at 23 to said lower ring 16 and on the other side at 24 to said upper ring 18 and each of them extends at least for a quarter of a circumference of the pourer part 13, as can be clearly seen in FIG. 7.

More specifically, the pourer part 13 therefore comprises an essentially cylindrical section 16, 17 and 18 and an actual pouring section 26, having a reduced diameter with respect to the cylindrical section, connected by a flat annular element or step 27, extending radially to connect the two portions 16, 17 and 18, and 26. In said flat annular element 27, there is an arrowed appendage 28 which also extends in an axial direction common to the whole cap (FIGS. 3, 4 and 5).

The cover part 12, substantially in the form of an inverted cup, internally provides a front pocket 30 suitable for being aligned with the arrowed appendage 28 which extends from the flat element or step 27 of the pourer part 13 when the cover part 12 is closed on the pourer part 13. The pocket 30 of the cover part 12 forms a non-releasable engagement coupling when the arrowed appendage 28 is pushed inside it, unless the parts forming this coupling are broken.

In this way, engagement means (arrowed appendage 28 and pocket 30 which receives at least one end of the arrowed appendage 28) are provided which are of the breakable type and are arranged partly on the cover part 12 and partly on the pourer part 13 and remain integral with at least one of said parts when they are broken when the cap is first opened.

Furthermore, the cover part 12 provides an opening flap 37 on the outside in a front part on which to act when the two parts 12, 13 are to be separated and access gained to the internal liquid product.

Radial teeth 31 are provided in the internal surface of the cover part 12, suitable for being brought into abutment engagement on the flat element or step 27 of the pourer part 13 when the cover part 12 is closed on the pourer part 13, ensuring a correct positioning of the parts.

An annular cuff 32 facing inwardly is provided at the upper end of the actual pouring section 26. Within and against said annular cuff 32 there is a first tubular extension 33 which forms part of and extends downwards from an upper wall 34 of the cover part 12. Coaxial to said first tubular extension 33 and also facing the same direction as the first tubular extension 33, a second tubular extension 35 extends from the upper wall 34 of the cover part 12, having a larger diameter with respect to that of the first extension 33. The two tubular extensions 33 and 35 are positioned within and astride of the upper end of the actual pouring section 26, even if it does not provide said annular cuff 32 facing inwardly, and perfectly seal a passage 36 inside the pourer part 13 produced for discharging the contents of the container or vessel on which the cap 11 according to the present invention is arranged.

FIGS. 1, 3 and 5 show the position between the parts of the cap when this is closed on a container filled with a liquid product, such as a drink with vitamin supplements, water containing additives in general, juice, tea, etc.

In this position closed and sealed by the company that produces the liquid product and packs it in the container, the cover part 12 is arranged integrally abutted above the pourer part 13. The collaboration of the extensions 33 and 35 previously described guarantees a good seal of the product inside the container. Furthermore, according to the present invention, the arrowed appendage 28 is positioned inside the pocket 30 of the cover part 12 and a non-releasable engagement coupling is formed between the parts 12, 13 of the cap 11.

A user who wishes to have access to the product to use it by acting for example on the opening flap 37 provided on the cover part 12 promotes its separation from the pourer part 13.

An action in this sense causes the breakage of at least the outer tip of the arrowed appendage 28 and its free end breaks and remains wedged inside the pocket 30 of the cover part 12 rotated around the hinge arrangement 15 (FIG. 6).

In this way, if this opening had been effected for removing the internal product and replacing it with a different product, for example having lower value and cost, it would then no longer be possible to restore the original closure and the first opening would be revealed.

Furthermore, if complete access to the mouth of the container C is desired, according to the present invention, both the cover part 12 and the pourer part 13 can be removed from the mouth of the container C. For this purpose, by pulling, for example, on the pourer part 13, this causes the breakage of the bridges both 21 and 22 and the detachment of the two string portions 17 from both the lower ring or tamper-proof ring 16 and from the upper ring 18. All of this without separating the cover part 12 and the pourer part 13 from the container.

The string portions 17 can also be present in a number of one and in any case, they form means which prevent the separation between the parts of the cover 12, 13 and the mouth of the container C on which the cap is arranged, even if the cap has been removed from the mouth.

This prevents the plastic material of the cap from being dispersed in the environment, respecting the requirements of the law and preventing the pollution of plastic material.

Figure 8:
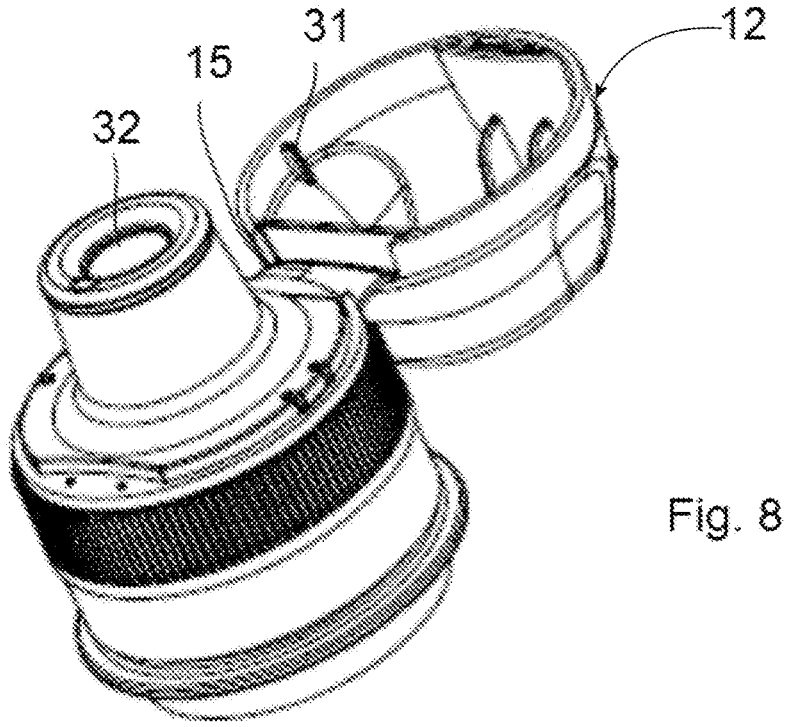
FIG. 8 is a perspective view of a cap completely analogous to that of FIG. 1 in an open position, but in which the pourer part of the cap is entirely produced in a continuous piece.

FIG. 8 shows a perspective view of a cap according to the present invention which is entirely similar to that of FIGS. 1 to 6 in an open position. In this embodiment, where identical elements are indicated with the same reference numbers, the pourer part 13 is produced entirely in one piece. It provides in fact cylindrical portions with different diameters comprising a lower ring or tamper-proof ring 16, followed by a second cylindrical central section 16' and an upper ring 18. Even in this case, the upper ring 18 is provided with an internally threaded portion in 19, and extends above in an externally knurled portion 20.

Even in this embodiment, in which the cap is produced in one piece, engagement means are provided between the two parts 12, 13 which are of the breakable type. On one side the arrowed appendage 28 and on the other side the pocket 30 which receives one end of the arrowed appendage 28. The free portion of the arrowed appendage 28 breaks upon the first opening and remains integrally wedged in the pocket 30 of the cover part 20 revealing the first opening of the cap (FIG. 6).

Figure 9:
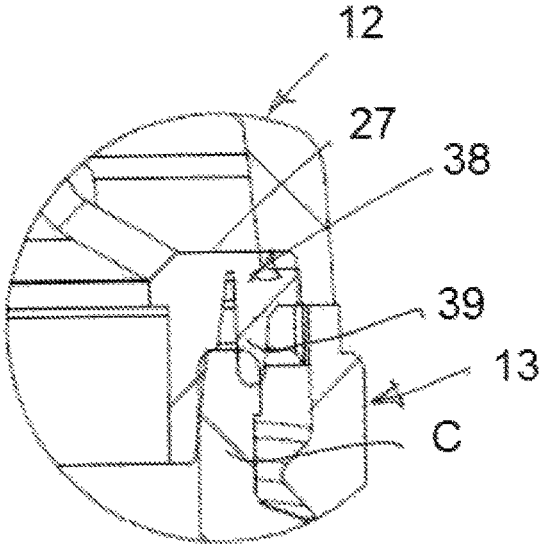
FIGS. 9 and 10 show enlarged details in a sectional view of further parts showing the first opening of the cap: in particular
Figure 10:
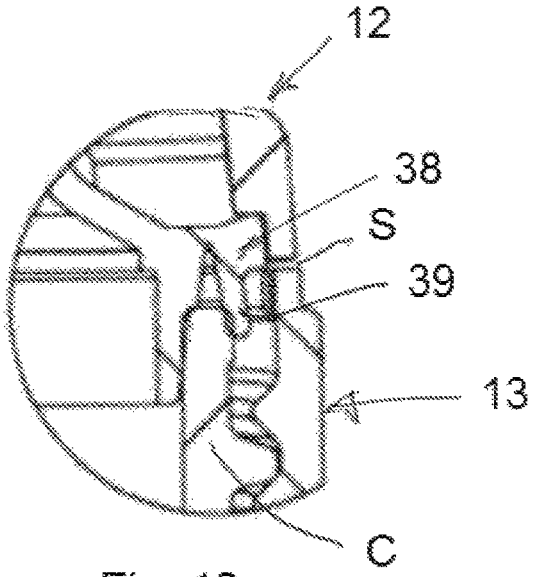

FIGS. 9 and 10 illustrate in a sectional view, enlarged details of further parts which reveal the first opening of the cap.

In particular, FIG. 9 illustrates what is shown in the circle D indicated in FIG. 1 with the cap intact.

In this position, an inverted L-shaped flap element 38, formed on the flat element or step 27 of the pourer part 13 is determined in such a position as to allow a complete closure between the cover part 12 and the pourer part 13. With the cap closed, in fact, a leg 39 facing downwards of this flap element 38 can be arranged between the parts in contact (FIG. 9).

After the first opening of the cap has been effected and an attempt has been made to close the cover part 12 over the pourer part 13, the leg 39 becomes engaged on the outer part of the mouth of the container C which pushes it towards the outside of the container C.

The interposition of this leg 39 of the flap element 38 between the parts therefore prevents closure between the parts, between the cover part 12 and the pourer part 13 (as shown in FIG. 10) and reveals that a first opening has been effected thanks to the space S that remains between the parts.

FIG. 10 shows these elements once a first opening has been effected and shows how it is no longer possible to close the cap perfectly as it is no longer possible to bring the cover part into contact with the pourer part below.

Figure 11:
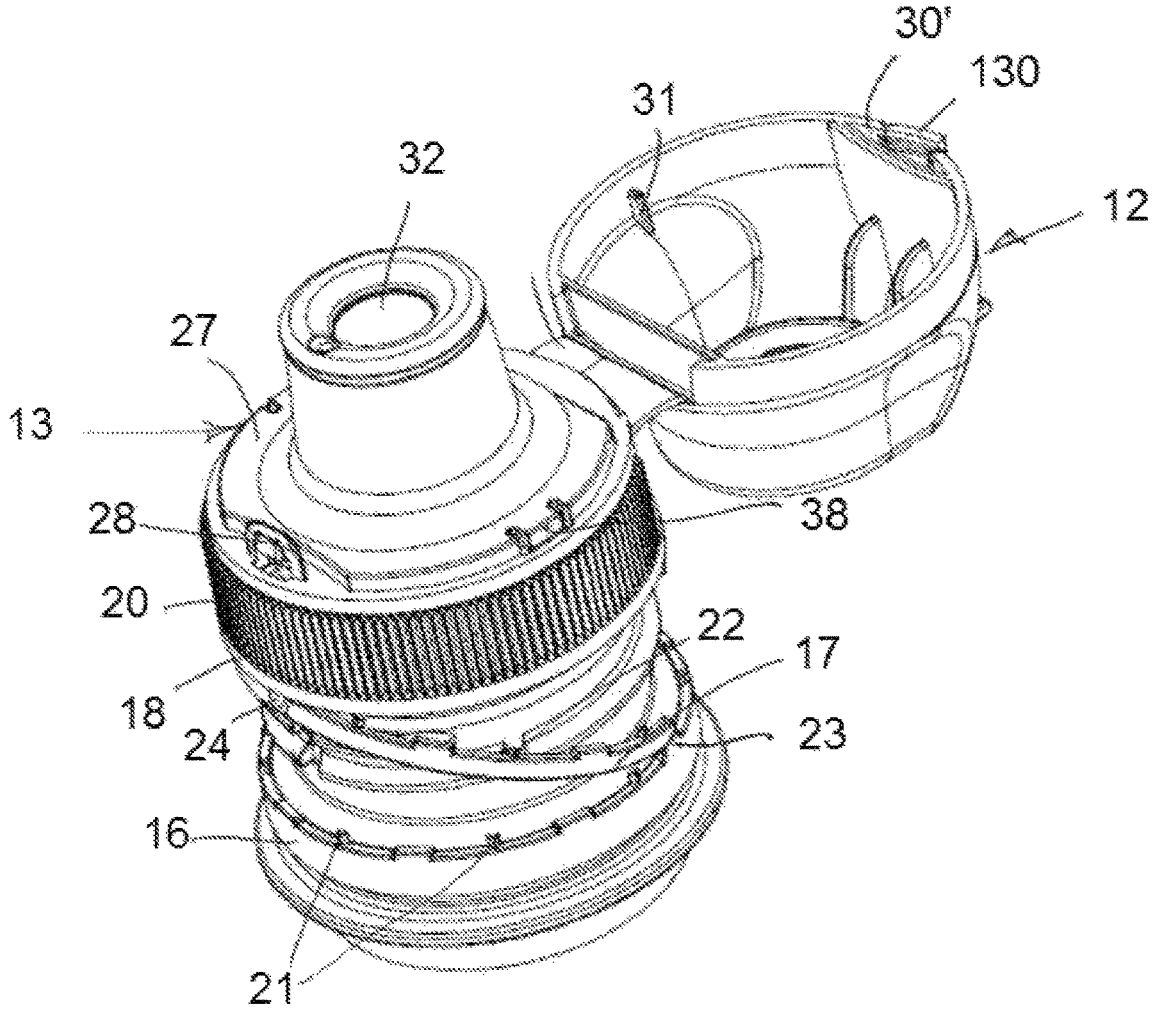
FIG. 11 is a perspective view of a flip top cap for containers with evidence of first opening according to the present invention in an open position, in which there is a second arrangement of breakable engagement means between the parts of the cap.

FIG. 11 shows a perspective view of a flip top cap for containers with evidence of first opening according to the present invention in an open position, in which there is a second arrangement of breakable engagement means between the parts of the cap, in a further embodiment that differs from the two previous examples.

Even in this embodiment, identical elements are indicated with the same reference numbers.

Here again, the cap comprises an outer protective cover part 12 and a pourer part 13, produced in a single piece. The cover part 12 is connected by means of a hinge arrangement 15 to the pourer part 13. In this further example, the pourer part 13 provides a cylindrical section which comprises a lower ring or tamper-proof ring 16, two string portions 17 and an upper ring 18, but the string portions 17 can also be absent.

Figure 12:
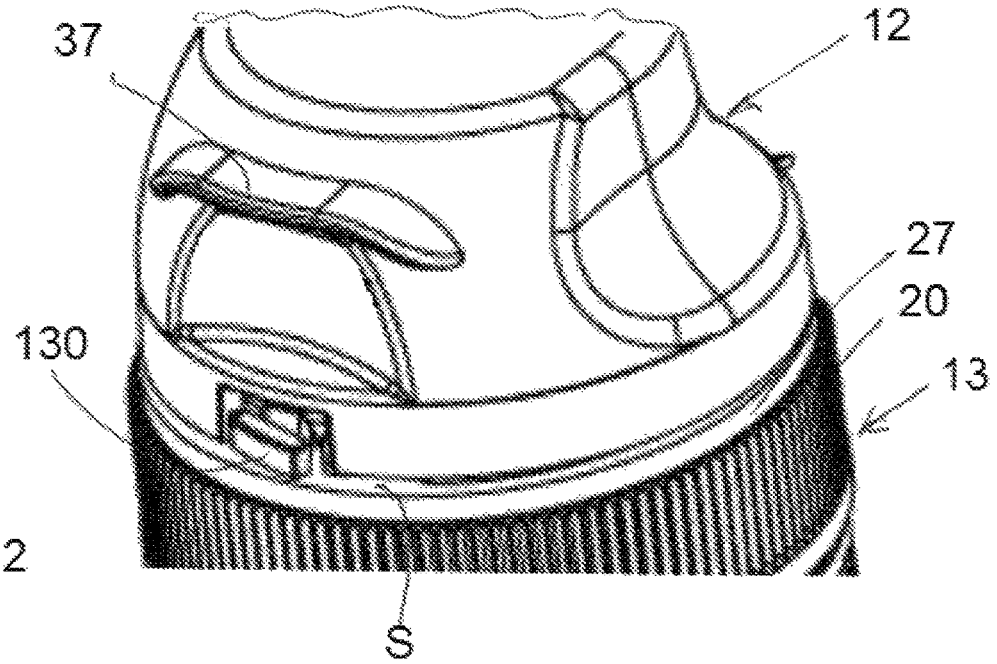
FIG. 12 shows an enlarged detail in a perspective view of the engagement means arranged partly on the cover part and partly on the pourer part which show breakage at the first opening of the cap of FIG. 11.

In this example, the pourer part 13, which comprises a flat annular element or step 27, also provides an arrowed appendage 28 which extends in an axial direction common to the whole cap. In this case, the cover part 12, in the form of an inverted cup, provides an internal front pocket 30' of the breakable type which is in any case suitable for being aligned with the arrowed appendage 28. The arrowed appendage 28 penetrates the pocket 30' when the cover 12 is closed over the pourer part 13. Here again, the pocket 30' of the cover part 12 forms a non-releasable engagement coupling when the arrowed appendage 28 is pushed inside it. This engagement can be eliminated by breaking at least one of its walls 130 of the parts that form the pocket 30'. FIG. 12 clearly shows what happens with at least one wall 130 partially detached from the cover part 12.

Engagement means are therefore also provided here (arrowed appendage 28 and pocket 30' which receives one end of the arrowed appendage 28) which are of the breakable type and are arranged partly on the cover part 12 and partly on the pourer part 13 and remain integral with at least one of said parts when they are broken when the cap is first opened.

FIG. 12 also shows how, thanks to the above-mentioned interposition of the leg 39 of the flap element 38 between the parts, the closure between the cover part 12 and the pourer part 13 is prevented. Evidence of this is the space S that remains between the lower end of the cover part 12 and flat annular element or step 27 of the pourer part 13 (as shown in FIG. 12) which is clear evidence that a first opening has been effected.

The cap of the embodiment of FIG. 11 can also be produced in a variant in which a pourer part 13 can be provided wherein the string portions 17 can also be absent.

Figure 13:
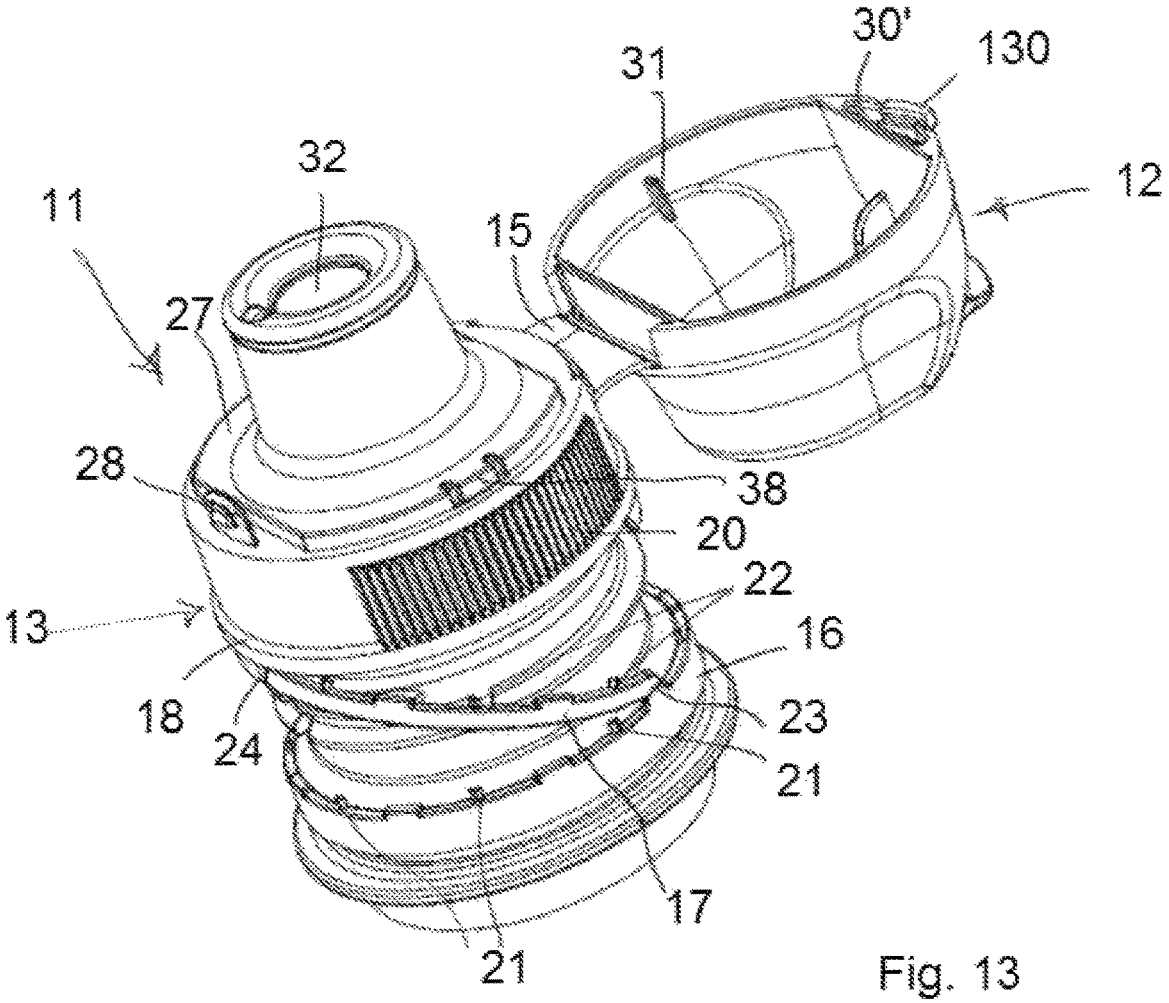
FIG. 13 is a perspective view of a flip top cap for containers with evidence of first opening according to the present invention in an open position, obtained with a different type of mound wherein the knurled part is located in two opposite sections and does not extend for the whole circumference.

FIG. 13 shows a further embodiment of a flip top cap for containers with evidence of first opening according to the present invention, wherein once again the same elements have the same reference numbers.

In this further example of a cap, shown in the open position of its cover part 12 and pourer part 13, a different type of mold is used and proposed.

Figure 14:
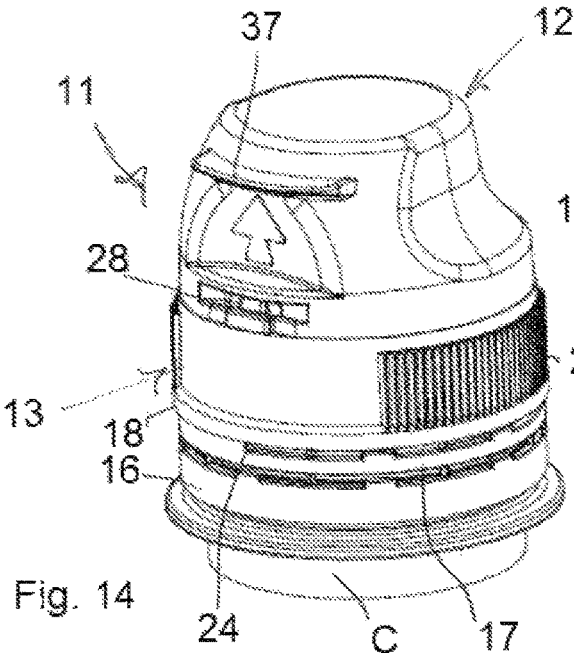
FIGS. 14 and 15 show the cap of FIG. 13 when it is closed and intact and after it has been opened for the first time.
Figure 15:
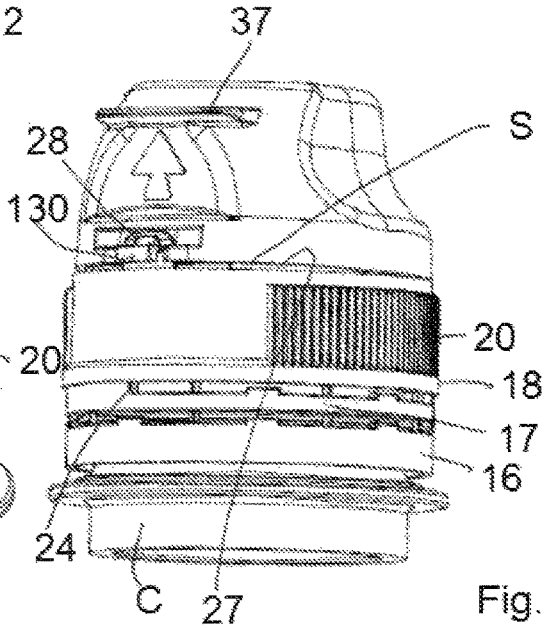

This is in fact an industrial mold defined as "two-cheeked" whereby the knurled part 20 is located in two opposite sections of the pourer part 13 and does not extend for its entire circumference. There is therefore the presence of two large smooth portions on a certain extension of the outer side wall of the pourer part 13 (FIG. 13). The other characteristics are completely unchanged and FIGS. 14 and 15 show the cap of FIG. 13 in different positions. FIG. 14 shows the cap in a first position when it is closed and intact.

FIG. 15 shows how the cap appears after it has been opened for the first time with evidence of at least one wall 130 of the parts that form the pocket 30' of the cover part 12 partially split and detached from it.

Even in this case, the pourer part 13 has been illustrated as having string portions 17 connected to both the lower ring or tamper-proof ring 16 and to the upper ring 18. This arrangement, as already mentioned, prevents the separation of the cover part 12 from the pourer part 13 from the container. In a possible variant, however, the string portions 17 of the pourer part 13 can also be absent and the corresponding surface of the pourer part 13 is in this case smooth.

Figure 16:
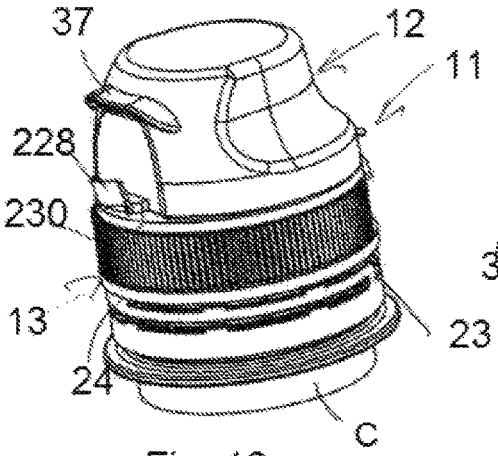
FIGS. 16 and 17 show perspective views of a further embodiment of the cap according to the invention in a closed position and in an open position.
Figure 17:
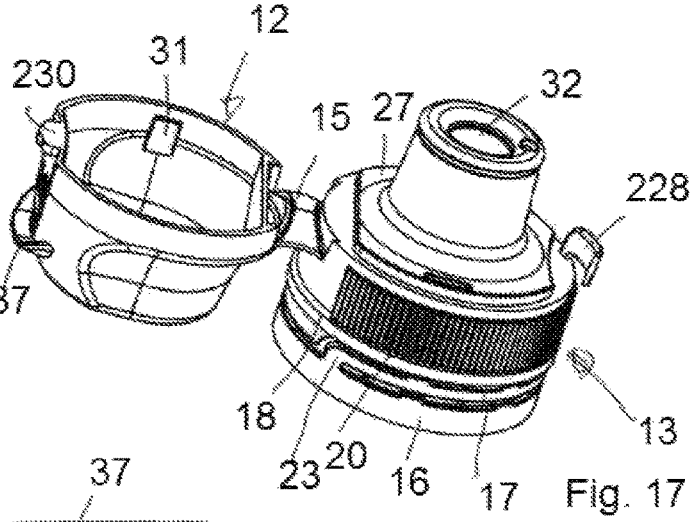
Figure 18:
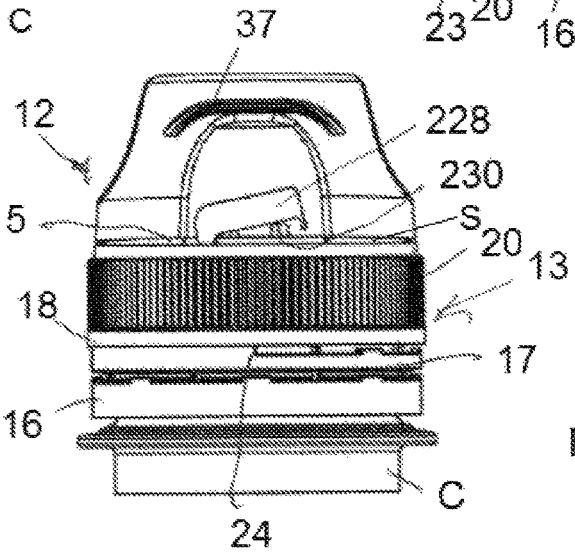
FIG. 18 shows a front view of the cap of FIGS. 16 and 17 when it has been opened with ample evidence of having been opened.

A further possible embodiment of a flip top cap for containers with evidence of first opening according to the present invention is shown in FIGS. 16 to 18. In this embodiment, where possible, the same elements have the same reference numbers.

Even in this embodiment the cover part 12 and the pourer part 13 are produced in a single piece by molding. Analogously, engagement means of the breakable type are provided, which are arranged partly on the cover part 12 and partly on the pourer part 13 and here again at least parts of said engagement means remain integral with at least one of the two pourer and cover parts, when they are broken at the first opening.

More specifically, in this variant the cover part 12 is provided with a shaped extension 230 projecting outwardly, which is arranged in engagement beneath an inverted U-shaped element 228 and constrained to the flat annular element or step 27 of the pourer part 13. The inverted U-shaped element 228 can be in the form of a two-pole flag at opposite ends.

When the cap is to be opened by acting on the opening flap 37 provided on the cover part 12, the shaped extension 230 is caused to push on the U-shaped element 228, at least partially promoting its separation from the pourer part 13.

FIG. 16 shows the cap intact constrained to an opening of a container C, whereas FIG. 17 shows how the parts are arranged after opening.

It can be noted that the U-shaped element 228 is at least partially separated from the pourer part 13 remaining attached to it only at one side of the U-shape. It can also be noted how this detachment, even if partial, is extremely evident for whoever is observing the cap and this is even more evident from FIG. 18 which shows the cap frontally.

FIG. 18 also shows how the lower end of the cover part 12 remains detached from the flat annular element or step 27 of the pourer part 13, defining a free space S which is clear evidence that a first opening has been effected.

Figure 19:
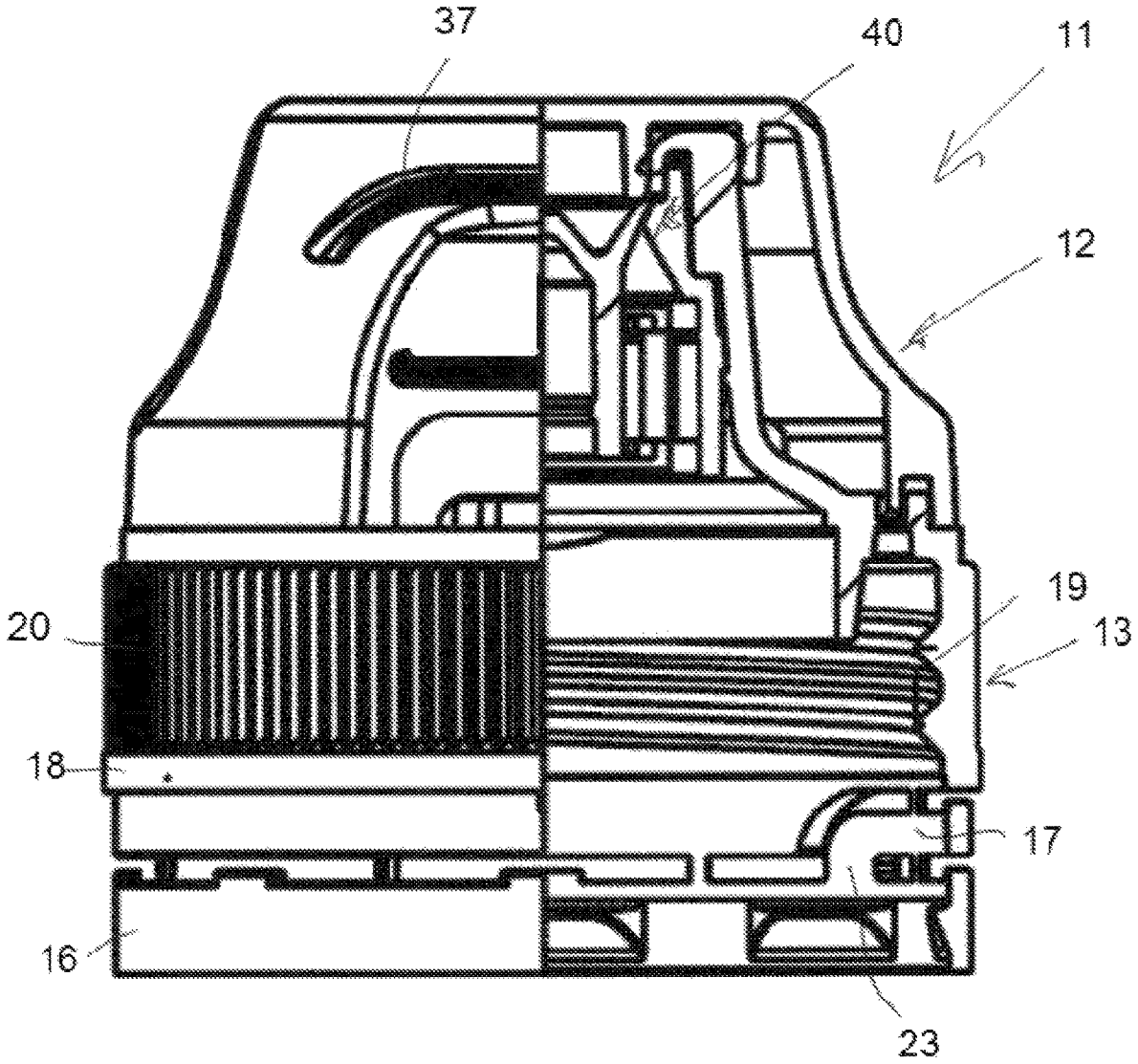
FIG. 19 shows an example of a cap according to the invention, half in a raised front view and half in a sectional view, wherein a valve element has been inserted for particular applications.

FIG. 19 shows an example of a cap according to the invention, half in a raised front view and half in a sectional view, wherein a valve element has been inserted, indicated as a whole with 40, to be used for particular applications. This valve element 40 can of course be inserted in any of the previous embodiments illustrated of the cap according to the invention. As shown, this valve element 40 is preferably inserted in the pourer part 13 of the cap.

The objective mentioned in the preamble of the description has thus been achieved.

The protection scope of the present invention is defined by the enclosed claims.

The invention claimed is:

1. A flip top cap for a container providing evidence of first opening, comprising:

a cover part;

a pourer part, the cover part and the pourer part being coupled together by a hinge arrangement, the cover part being rotatable around the hinge arrangement to be brought from a closed position engaging the pourer part to an open and separate position with respect to the pourer part;

an engagement system that engages the cover part on the pourer part after rotation into the closed position, wherein the cover part and the pourer part are produced in a single piece by molding, wherein the engagement system is of a breakable type that makes it impossible to restore an original closure after the first opening, the engagement system being arranged partly on the cover part and partly on the pourer part and remaining integral with at least one of the cover or pourer parts when the cover and the pourer parts are separated by breaking at the first opening, wherein the engagement system of the breakable type is configured, in one part, as an arrowed appendage which extends from the pourer part in a longitudinal direction of the flip top cap and, in a second part, as a pocket, which is defined in the cover part and which receives at least one end of the arrowed appendage, wherein the pourer part comprises a cylindrical portion and a pouring portion having a reduced diameter with respect to the cylindrical portion, the cylindrical portion and the pouring portion being connected by a flat step that extends radially from an upper edge of the cylindrical portion to a lower edge the pouring portion, further comprising an inverted L-shaped flap element, which extends from the flat step defined on the pourer part to define a leg that faces downward, and wherein, in the closed position of the flip top cap, the leg is inserted between the cover part and the pourer part so as to enable a complete closure between the cover part and the pourer part, and after a first opening, the leg faces downwards with respect to an axis of the flip top cap and is arranged and engages an external part of a mouth of the container, which pushes the leg outwardly and prevents a complete closure in contact between the cover part and the pourer part.

2. The flip top cap according to claim 1, further comprising a separation member that prevents a separation between the cover part and the pourer part, when the flip top cap is removed from a mouth of the container on which the separation member is arranged.

3. The flip top cap according to claim 2, wherein the separation member is configured as a string that is connected with a first end to a lower ring of the pourer part and with a second end to an upper ring of the pourer part.

4. The flip top cap according to claim 3, wherein the string extends for at least a quarter of a circumference of the pourer part.

5. The flip top cap according to claim 1, wherein the arrowed appendage is of a breakable type.

6. The flip top cap according to claim 1, wherein the pocket is of a breakable type.

7. The flip top cap according to claim 1, wherein the pocket is of the breakable type in at least one of its walls.

8. The flip top cap according to claim 1, wherein the engagement system of the breakable type is in one part a shaped extension projecting outwardly from the cover part and in another part an inverted U-shaped element constrained to the flat step of the pourer part, in which the shaped extension is engaged.

9. The flip top cap according to claim 8, wherein the inverted U-shaped element is of a breakable type.

10. The flip top cap according to claim 1, wherein the flip top cap has at least one valve element inserted therein.

* * * * *